US008578658B2

(12) United States Patent
Snell

(10) Patent No.: US 8,578,658 B2
(45) Date of Patent: Nov. 12, 2013

(54) GUTTER COVER APPARATUS

(76) Inventor: Todd Snell, Atlanta, GA (US)

( * ) Notice: Subject to any disclaimer, the term of this patent is extended or adjusted under 35 U.S.C. 154(b) by 180 days.

(21) Appl. No.: 12/658,151

(22) Filed: Feb. 3, 2010

(65) Prior Publication Data

US 2011/0185641 A1 Aug. 4, 2011

(51) Int. Cl.
*E04D 13/00* (2006.01)

(52) U.S. Cl.
USPC ..... 52/12; 52/97; 210/474

(58) Field of Classification Search
USPC ..... 52/11, 12, 13, 14, 15, 16, 97; 210/474
See application file for complete search history.

(56) References Cited

U.S. PATENT DOCUMENTS

| | | | | |
|---|---|---|---|---|
| 4,745,710 | A * | 5/1988 | Davis | 52/12 |
| 5,010,696 | A * | 4/1991 | Knittel | 52/12 |
| 5,459,965 | A * | 10/1995 | Meckstroth | 52/12 |
| 6,412,228 | B1 * | 7/2002 | Meckstroth | 52/12 |
| 6,786,008 | B2 * | 9/2004 | Brochu | 52/12 |
| 6,968,651 | B2 * | 11/2005 | Bergeron | 52/12 |
| D565,706 | S * | 4/2008 | Murray | D23/261 |
| 7,707,781 | B2 * | 5/2010 | Van Cleave et al. | 52/11 |
| 7,793,465 | B2 * | 9/2010 | McCann | 52/12 |
| 7,805,889 | B2 * | 10/2010 | Barnett | 52/12 |
| 7,908,797 | B2 * | 3/2011 | Graves | 52/12 |
| 2002/0166290 | A1 * | 11/2002 | Bergeron | 52/12 |
| 2003/0009951 | A1 * | 1/2003 | Bergeron | 52/12 |
| 2003/0046876 | A1 * | 3/2003 | Higginbotham | 52/11 |
| 2003/0070366 | A1 * | 4/2003 | Beyers | 52/12 |
| 2004/0182014 | A1 * | 9/2004 | Brochu | 52/12 |
| 2006/0000154 | A1 * | 1/2006 | Wirbel | 52/12 |
| 2006/0107603 | A1 * | 5/2006 | Brownridge | 52/11 |
| 2006/0123710 | A1 * | 6/2006 | Lenney et al. | 52/12 |
| 2006/0179723 | A1 * | 8/2006 | Robins | 52/11 |
| 2006/0201068 | A1 * | 9/2006 | Shane | 52/11 |
| 2007/0169423 | A1 * | 7/2007 | Brochu | 52/12 |
| 2007/0199249 | A1 * | 8/2007 | Beck et al. | 52/12 |
| 2008/0010906 | A1 * | 1/2008 | Brochu | 52/12 |
| 2008/0190040 | A1 * | 8/2008 | Graves | 52/12 |
| 2009/0000210 | A1 * | 1/2009 | Barnett | 52/12 |
| 2009/0013612 | A1 * | 1/2009 | Brochu | 52/12 |
| 2009/0031638 | A1 * | 2/2009 | Iannelli | 52/12 |
| 2009/0108144 | A1 * | 4/2009 | Brochu | 248/48.1 |
| 2010/0071273 | A1 * | 3/2010 | Joly et al. | 52/12 |
| 2011/0041414 | A1 * | 2/2011 | Bell | 52/12 |
| 2011/0107683 | A1 * | 5/2011 | Ringuette | 52/12 |
| 2011/0126477 | A1 * | 6/2011 | Hurn | 52/12 |
| 2011/0138697 | A1 * | 6/2011 | Martin | 52/12 |
| 2011/0138698 | A1 * | 6/2011 | Neumann | 52/12 |
| 2011/0162289 | A1 * | 7/2011 | Cangialosi | 52/12 |

* cited by examiner

*Primary Examiner* — Robert Canfield
*Assistant Examiner* — Matthew Gitlin

(57) ABSTRACT

A gutter cover apparatus configured to fit the top of a conventional roof gutter is characterized by an elongated sheet member having a longitudinal front edge portion, a longitudinal rear edge portion, and a substantially planar intermediate portion therebetween. The intermediate portion, in turn, is characterized by at least one upstanding longitudinal ridge defining multiple drainage zones each containing a pattern of staggered rows of openings. The forward longitudinal edge portion of the sheet member is raised upwardly with respect to the drainage zones and together with the ridge retards the flow of water transversely with respect to the front edge of the gutter.

14 Claims, 3 Drawing Sheets

FIG 3
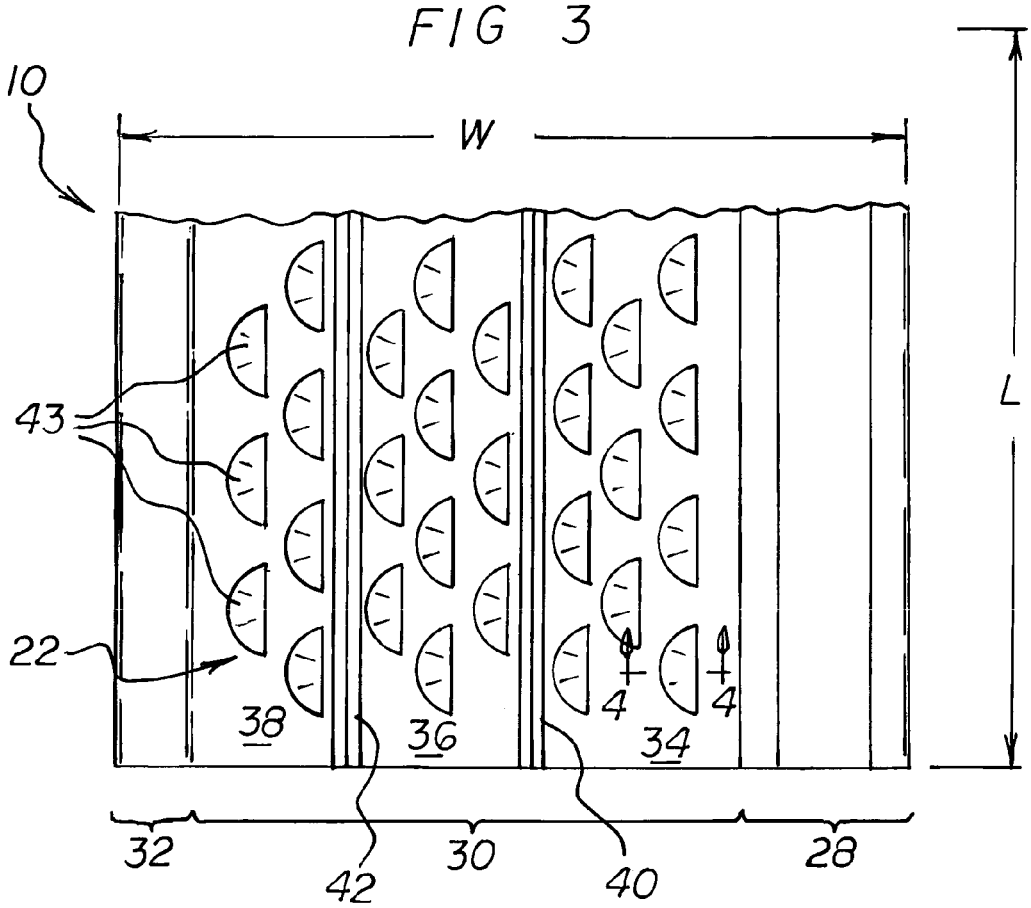
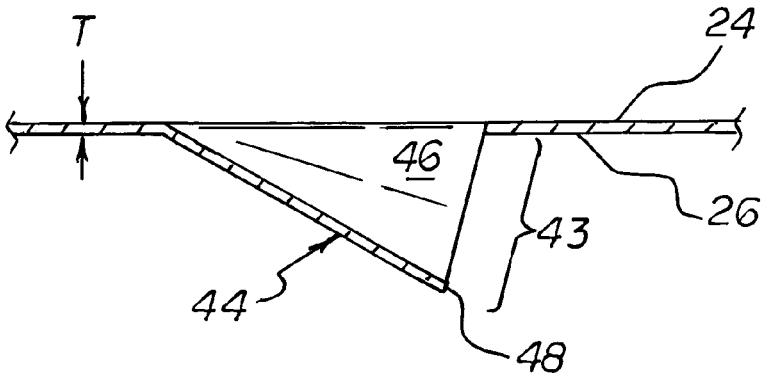
FIG 4

FIG 5
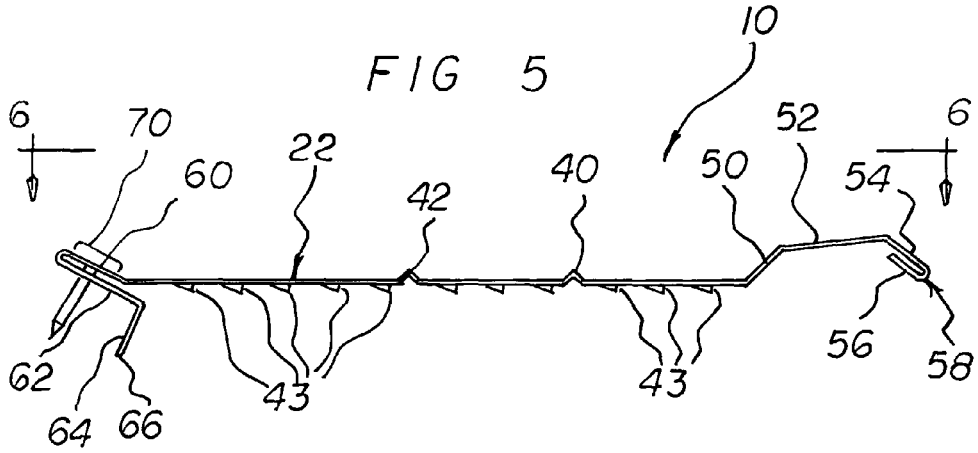
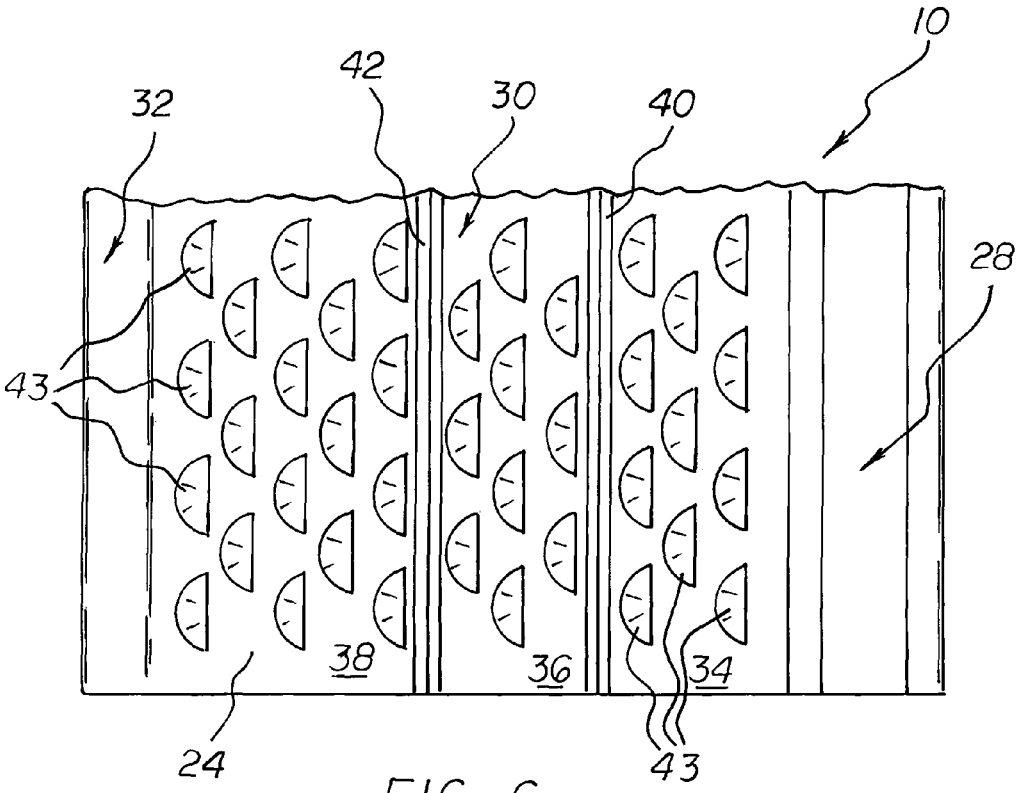
FIG 6

GUTTER COVER APPARATUS

BACKGROUND OF THE INVENTION

1. Field of the Invention

The present invention relates generally to gutter covers, and, more particularly, to a unique gutter cover apparatus for permitting rainwater to enter a roof gutter without permitting leaves or other debris from entering the gutter and causing clogging.

2. Description of the Prior Art

Gutters are placed next to the edge of a roof to collect water runoff and to direct the runoff away from a building structure. At times, leaves and other debris can accumulate in the gutters and can clog the drain holes or downspouts associated with the gutters. Removal of such leaves or debris from a roof gutter is laborious, time consuming and possibly hazardous. To overcome these challenges, gutter covers, shields or protectors can be installed over the gutters to prevent debris from accumulating in the gutters without impeding the flow of rainwater into the gutter trough. Throughout the years, a number of innovations have been developed relating to such gutter covers and the following prior U.S. patents are noted as being exemplary.

U.S. Pat. No. 2,288,121 (Cisar et al) describe a gutter protector in the form of a substantially flat sheet of rigid sheet metal having a pattern of oblong-shaped drainage perforations therein. The protector is maintained in place by having its front edge engage a flange running longitudinally along the front edge of the gutter and by having its rear edge bent downwardly to rest on a gutter hanger. The drainage perforations in the sheet metal protector are relatively large requiring frequent removal and cleaning of the gutter.

U.S. Pat. No. 2,365,845 (Schweda) discloses a substantially flat strip of screening material attached to a gutter structure with front and rear channel strips. The strip may be removed to clean the gutter as debris invariably works its way through the openings defined by the mesh of the screening material and no provision is made to prevent wet leaves sticking to the screen material.

U.S. Pat. No. 2,583,422 (Haddon) discloses a gutter cover in the form of a concave sheet having a pattern of upstruck swedges defining openings therein. The sheet is supported on front and rear ends by flanges on the outer gutter edge and clips slipped under shingles on the adjacent section of roof, respectively. Because of its concave shape, and the upward cant of the swedges defining the openings in this form of cover, the cover tends to become more easily clogged by clinging wet leaves than is otherwise desired reducing its effectiveness.

U.S. Pat. No. 6,904,718 (Fox) describes a "leaf guard" for a roof gutter comprising an elongated sheet of rigid material having a substantially flat planer middle section, an inwardly bent connection section, and a curved nose section. The planar middle section has one or more rows of slits running perpendicular to the adjacent roof edge. No means are provided in this arrangement for preventing leaves or other debris from being plastered against the slit openings, sticking in place, and reducing drainage effectiveness.

U.S. Pat. No. 6,412,228 (Meckstroth) discloses an elongated cover or strip formed of extruded plastic material. The cover has a straight portion for engagement underneath the shingles at the edge of the adjacent roof, and a hooked nose portion for engagement with the front edge of the gutter. Such plastic gutter protectors are relatively expensive to fabricate and are susceptible to discoloration and/or cracking over time from exposure to sunlight.

Thus, while the foregoing body of prior art indicates it to be well known to use different types of gutter covers, the prior art described above does not teach or suggest a gutter cover apparatus which has the following combination of desirable features: (1) provides a cover for gutter that is easy to install, relatively inexpensive to fabricate, and is durable over time; (2) provides a gutter cover that includes an enhanced number of drainage openings per unit/area thereby efficiently draining rainwater runoff into a roof gutter all of the while protecting the gutter from filling with leaves or other debris; (3) provides a gutter cover that includes means for preventing wet leaves or other debris from sticking in place over the openings in the gutter cover and thereby reducing its effectiveness; (4) provides means for retarding the flow of water runoff across the surface of the cover to help reduce the velocity of the flowing water and help lift debris away from the surface of the cover; (5) provides a gutter cover that includes means for reducing the amount of debris lodging behind the gutter structure; and (6) provides a gutter cover that includes a front drip edge so configured and constructed to reduce staining of the gutter's front surface (i.e. eliminate "tiger striping").

The foregoing desired characteristics are provided by the unique gutter cover apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a gutter cover apparatus comprising a relatively thin, elongated generally planar sheet member, preferably of metallic material, suitably sized and configured to fit over and cover the top of a conventional roof gutter. The elongated sheet member has a longitudinal front edge portion, a longitudinal rear edge portion, and a generally planar intermediate portion therebetween. The intermediate portion, in turn, is characterized by first and second upstanding longitudinal spaced ridges or protuberances, spaced from each other and extending generally parallel to each other and to the front edge portion and the rear edge portion of the sheet member, substantially the full length thereof. The first and second upstanding spaced ridges define first, second and third drainage zones each containing a pattern of staggered rows of openings, each one of which opening is in the form of a downwardly depending semi-cylindrical or arcuate-shaped spout opening below the bottom surface of the sheet member and facing forwardly thereof. The rear longitudinal edge portion of the sheet member is bent suitably to form an upstanding "spoiler" or debris blocking section and is bent further downwardly terminating in a longitudinally extending distal edge defining a bearing surface for the rear portion of the sheet member. The forward longitudinal edge portion of the sheet member is raised upwardly with respect to the drainage zones on the intermediate portion of the sheet member to define a downwardly directed "drip lip" and a bearing surface for the front of the sheet member with respect to the front edge of the gutter to which operatively it may be attached.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gutter cover apparatus which has all of the advantages of the prior art and none of the disadvantages.

It is another object of the present invention to provide a new and improved gutter cover apparatus which may be easily and efficiently manufactured and marketed.

It is a further object of the present invention to provide a new and improved gutter cover apparatus which is of durable and reliable construction.

An even further object of the present invention is to provide a new and improved gutter cover apparatus which is susceptible of a low cost of manufacture with regard to both materials and labor, and which accordingly is then susceptible of low prices of sale to the consuming public, thereby making such gutter cover apparatus available to the buying public.

Still yet a further object of the present invention is to provide a new and improved gutter cover apparatus that is easy to install, relatively inexpensive to fabricate, and is durable over time.

Still another object of the present invention is to provide a new and improved gutter cover apparatus that includes an enhanced number of drainage openings per unit/area thereby efficiently draining rainwater runoff into a roof gutter all of the while protecting the gutter from filling with leaves or other debris.

Yet another object of the present invention is to provide a new and improved gutter cover apparatus that includes means for preventing wet leaves or other debris from sticking in place over the openings in the gutter cover thereby reducing its effectiveness.

Even another object of the present invention is to provide a new and improved gutter cover apparatus that provides means for reducing the amount of debris lodging behind the gutter structure.

Still a further object of the present invention is to provide a new and improved gutter cover apparatus that includes a drip edge so configured and constructed to help reduce staining of the gutter's front surface (i.e. eliminate "tiger striping").

Yet another object of the present invention is to provide a new and improved gutter cover apparatus that comprises an elongated sheet member having a longitudinal front edge portion, a longitudinal rear edge portion, and a generally planar intermediate portion therebetween and wherein the intermediate portion is characterized by first and second upstanding longitudinal spaced ridges or protuberances, spaced from each other and extending generally parallel to each other, and extending generally parallel to the front edge portion and the rear edge portion of the sheet member, substantially the full length thereof, respectively.

Still another object of the present invention is to provide a new and improved gutter cover apparatus which provides a sheet member having an intermediate portion situated between front and rear longitudinally extending edge portions, and whereas the intermediate portion includes staggered rows of openings, each one of which opening is in the form of a spout-like opening downwardly depending below the bottom surface of the sheet member and facing forwardly thereof.

Even yet another object of the present invention is to provide a new and improved gutter cover apparatus that includes a rear longitudinal edge portion formed suitably to define an upstanding dam or "debris blocking" section downwardly terminating in a longitudinally extending distal edge defining a bearing surface for the rear portion thereof.

Still yet another object of the present invention is to provide a new and improved gutter cover apparatus in the form of a sheet member and wherein the sheet member has a forward longitudinal edge portion to define a downwardly directed "drip lip" and wherein the forward edge portion further defines a bearing surface for the front of the sheet member with respect to the front edge of the gutter to which operatively the sheet member may be attached.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is an enlarged fragmentary top plan view of the embodiment of the gutter cover apparatus of FIG. 2.

FIG. 4 is an enlarged cross-sectional view taken along line 4-4 of FIG. 3.

FIG. 5 is an end view of an alternatively preferred embodiment of the gutter cover apparatus according to the invention.

FIG. 6 is a top plan view of the alternatively preferred embodiment of the invention taken along line 6-6 of FIG. 5.

DESCRIPTION OF THE PREFERRED EMBODIMENT

With reference to the drawings, a new and improved gutter cover apparatus embodying the principles and concepts of the present invention will be described.

Figure 1:
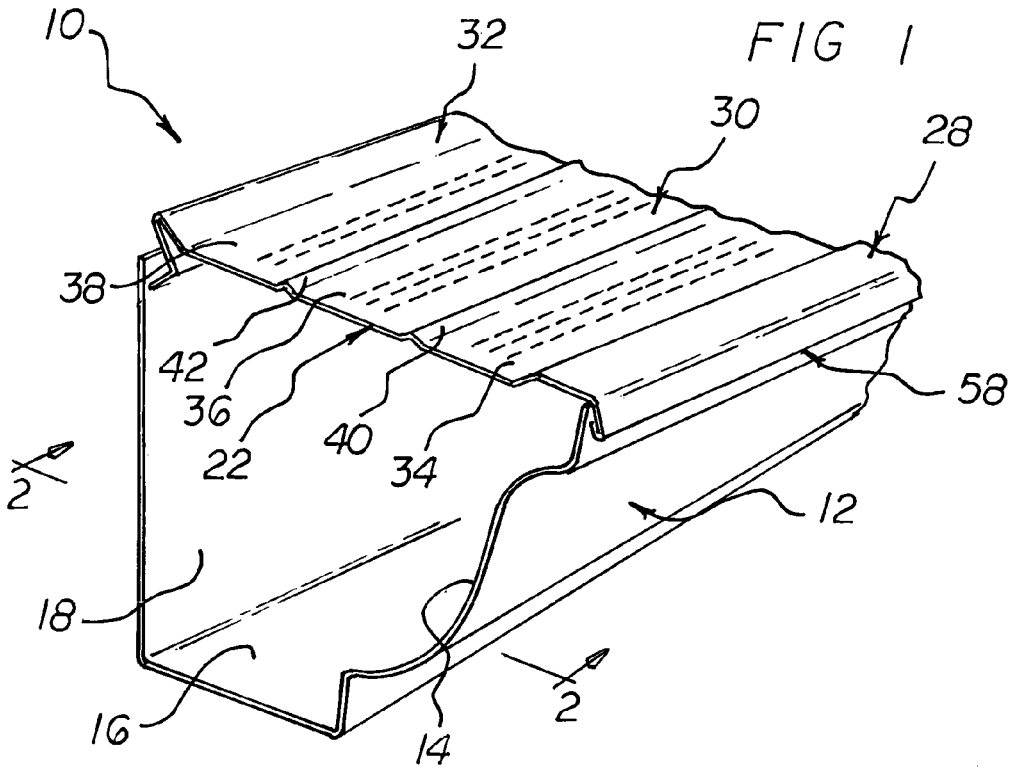
FIG. 1 is a perspective schematic view showing a preferred embodiment of the gutter cover apparatus of the invention installed on a gutter section.
Figure 2:
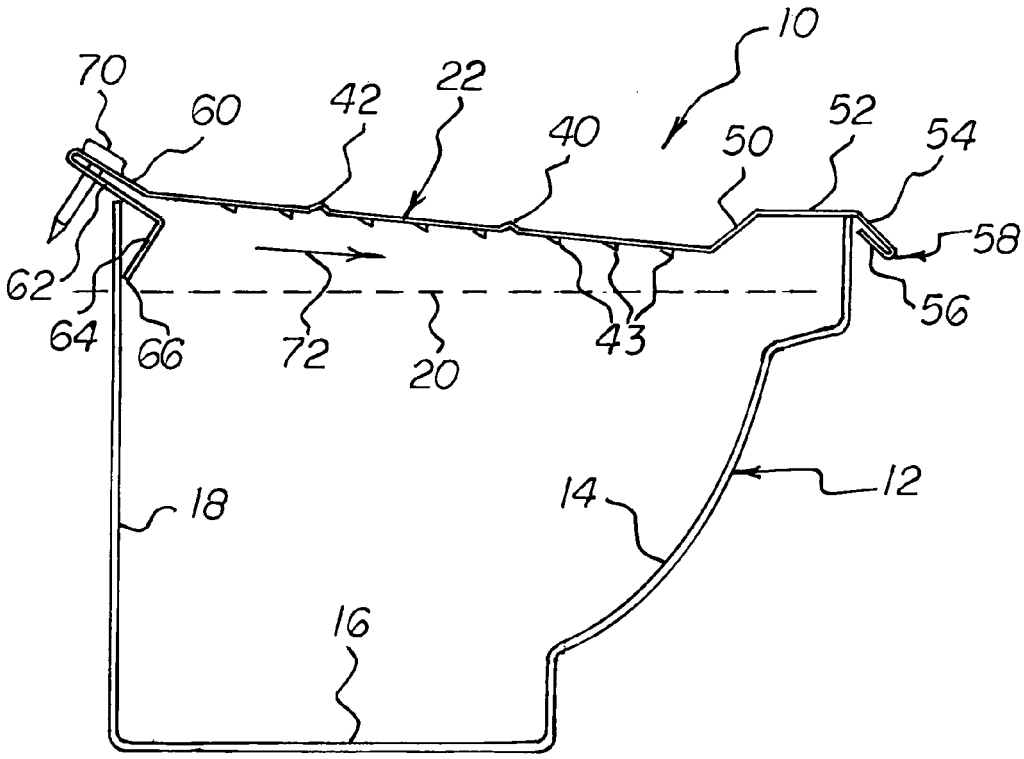
FIG. 2 is an enlarged end view of the embodiment of the gutter cover apparatus shown in FIG. 1 taken along line 2-2 of FIG. 1.

Turning initially to FIGS. 1-4, there is shown a preferred embodiment of the gutter cover apparatus of the invention generally designated by reference numeral 10. As shown in FIGS. 1 and 2, gutter cover apparatus 10 is adapted to be installed on top of a section of conventional gutter construction wherein the gutter 12 includes a front wall 14, a bottom wall 16, and a rear wall 18. It will be appreciated that gutter 12 may be suitably attached to a building structure (not shown) adjacent the roof eave of a building structure in order to collect runoff rainwater from the roof. One typical way of suitably attaching the gutter to the fascia board adjacent the roof eave is to use a conventional gutter hanger spike (not shown) suitably driven through the gutter and into the fascia board along an imaginary axis indicated by reference sign 20 in FIG. 2. The foregoing practice of attaching rain gutters to building structures is well known and outside the scope of the present invention. In this regard, the interested reader is referred to FIGS. 1 and 2 in the Cisar et al U.S. Pat. No. 2,288,121, and associated text therein, for a complete disclosure of same, which patent and disclosure are hereby incorporated herein and made part of the present specification by this reference.

In accordance with the invention, gutter cover apparatus 10 comprises an elongated generally planar sheet member 22 having a thickness "t," a length "l" and a transverse extent or width "w." The sheet member 22 preferably is of metallic material with enamel coated-aluminum being mostly preferred. Sheet member 22 is further characterized by a top surface 24, a bottom surface 26, a longitudinally extending front portion 28, a longitudinally extending intermediate or substantially central portion 30, and a longitudinally extending rear portion 32, substantially as depicted.

Intermediate portion 30, in turn, preferably is divided into three longitudinally extending sections or "drainage zones" 34, 36, 38 by first and second upwardly extending ridges or protuberances 40 and 42, each of which has a generally triangular-shaped cross-sectional profile substantially as depicted, the peak or apex of which is elevated with respect to the top surface 24 of the sheet member and especially with respect to drainage zones 34-38. As depicted, first and second upwardly extending ridges 40, 42 are arranged to extend longitudinally in a substantially parallel manner with respect to each other. Additionally, ridges 40, 42 preferably are arranged to extend parallel and longitudinally with respect to the front edge of the apparatus defined by drip lip 58, and to the distal bearing edge 66 defined by rear portion 32, as will become more apparent below.

Each drainage zone 34-38 includes a pattern of drainage holes 43 suitably provided therein for allowing rainwater runoff from a building roof impinging on top surface 24 to enter the interior of gutter 12. As shown in FIG. 4, each drainage hole or opening 43 preferably is in the form of a downwardly directed spout or louver 44 embossed, swedged or otherwise formed into the material of sheet member 22. Spout 44 is characterized by a semi-circular or other arcuate-shaped downwardly depending wall 46 terminating in a forwardly facing lip 48 (FIG. 4). It will be noted that arcuately shaped spout wall 46 lies entirely below the top surface 24 of the sheet member intermediate portion and that the opening 43 extends below bottom surface 26 in an almost, but not quite vertical disposition. As a result of this construction, the top surface 24 of intermediate section 30 is substantially flat and smooth, but for ridges 40 and 42.

In each drainage zone, rows of individual openings 43 are provided in a staggered relationship. In the preferred arrangement, shown in FIG. 3, in drainage zone 34, first, second and third such staggered rows are provided; in drainage zone 36, first, second and third such staggered rows are provided; and in drainage zone 38, first, and second such staggered rows are provided, all as substantially illustrated. Preferably the rows of openings 43 in all three drainage zones are arranged relative to each other to provide a uniform pattern of staggered rows (or diagonally arranged rows) with respect to the entire intermediate portion 30 of the sheet member 22 substantially as depicted in FIG. 3. The foregoing arrangement of staggered rows maximizes the number of openings 43 per unit area of the surface of intermediate member 30.

Front longitudinally extending portion 28 extends forwardly from intermediate portion 30 and includes a first longitudinally extending section 50 bent upwardly at a first angle with respect to the plane or top surface of intermediate portion 30, a second longitudinally extending section 52 bent forwardly at a second angle with respect to the plane of section 50, and a third longitudinally extending section 54 bent downwardly with respect to the plane of second section 52 substantially as depicted in FIGS. 1-2. Third section 54 is bent back upon itself at 56 to define a downwardly directed longitudinally extending "drip lip" 58 adapted to overhang front wall 14 of gutter 12 when the gutter cover apparatus 10 is installed on the gutter (FIGS. 1 and 2). Moreover, substantially as depicted, the first longitudinally extending section 50 and the second longitudinally extending section 52 form a raised "dam" portion rising above and forwardly with respect to the top surface of the adjacent intermediate portion 30, the purpose of which "dam" is to retard water from flowing across the intermediate portion of the sheet member and over the drip lip 58.

Rear longitudinally extending portion 32 extends rearwardly and upwardly from intermediate portion 30 and includes a first longitudinally extending section 60 bent upwardly at an angle with respect to the plane of intermediate portion 30, and a second section bent back upon first section 60 at 62. Second section 62 is bent downwardly and rearwardly at an angle with respect to second section 62 to define a third section 64 which in turn defines a distal longitudinally extending edge 66.

In accordance with the present invention, longitudinally extending distal edge 66 can function as a bearing edge enabling the rear end of the gutter cover apparatus to rest on conventional gutter hanger spikes or brackets indicated by imaginary axis 20. Thus, as shown in FIGS. 1 and 2, when installed on a gutter 12, the gutter cover apparatus 10 can have its rear portion rest on the gutter's support spikes via engagement of distal edge 66 with the top of the gutter spikes, and can have its front portion rest on the front wall 14 via the underside of second longitudinally extending section 52 engaging the top edge of front wall 14.

In order to more securely affix the gutter cover apparatus 10 in its intended operative position (FIG. 2), and as schematically indicated in FIG. 2, a plurality of longitudinally spaced nails, or rivets, or other suitable fasteners 70 can suitably be driven through rear sections 60 and 62 of rear longitudinally extending portion 32 into the fascia board behind the gutter (not shown). In this orientation, depicted in FIG. 2, cover apparatus 10 is suitably inclined from back to front and such downwardly sloping orientation will cause water runoff from the adjacent roof to flow along the transverse extent of the intermediate portion 30 in the direction schematically indicated in FIG. 2 by arrow 72. Optionally, the series of spaced fasteners 70 suitably can be driven through section 52 of front portion 28 diagonally into the top portion of the front wall of gutter 12 underlying drip lip 58 to suitably more securely affix gutter cover apparatus 10 in its intended operative position (FIG. 2) as will occur to those of ordinary skill in the gutter installation art.

It should also be appreciated that as a result of the upward and rearward orientation of sections 60 and 62 with respect to the top edge of rear wall 18, rear longitudinally extending portion 32 functions a rear "spoiler" effectively blocking leaves and other debris form getting lodged behind the gutter and between the rear wall 18 of gutter 12 and the adjacent fascia board (not shown).

An important feature of the present invention is the provision of the aforementioned longitudinally extending spaced ridges 40 and 42 which tend to maintain any wet leaves or other debris in a raised or lifted condition with respect to top surface 24 of sheet member 22. As a result of this unique arrangement, the flow of runoff rainwater across this top surface will easily wash away the "lifted" leaves and other debris preventing them from sticking and clogging drainage openings 42. Furthermore, the upstanding ridges 40, 42 together with the raised second longitudinally extending section 52 (and angled section 50) of front portion 28 serve the dual purpose of functioning as "speed bumps" slowing or impeding the flow of runoff water transversely across the intermediate portion 32. Such "speed bumps" impede the flow water helping to lift any leaves or debris and influencing the runoff to more easily to enter the gutter through openings 43 rather than pour over the front of the gutter 12 thereby defeating the latter's purpose and/or leading to an unsightly water staining condition known as "tiger stripes" on the front wall surface of the gutter. In any event, should any such overpour condition occur, the provision of third section 54 defining the downwardly directed longitudinally extending "drip lip" 58 in accordance with the present invention will help to avoid such staining ("tiger stripes").

In the preferred embodiment of FIGS. 1-4, the transverse width dimension "w" can be selected to suitably fit a conventional 5 inch gutter. In the alternatively preferred embodiment of FIGS. 5 and 6, the transverse width dimension is chosen to suitably fit a 6 inch gutter. It will be noted that in the alternative embodiment of FIGS. 5 and 6, the intermediate portion 30 is wider and the third drainage zone includes an increased number of staggered rows of openings 43 (namely 5 compared to 2 as in the prior embodiment).

Without limiting the present invention, and merely for purposes of illustration, the prior embodiment may have an intermediate portion 30 having a transverse extent (width) of 3.75 inches with a transverse spacing between ridges of 1.25 inches whereas in the alternatively preferred embodiment (FIGS. 5 and 6), the transverse extent (width) dimension of the intermediate portion may be 4.75 inches with the same spacing between raised ridges. In both embodiments, the drainage hole dimensions may be the same namely: 0.625 inches width, 0.25 inches depth, 0.25 inches spacing distance of adjacent openings in a given row, and 0.375 spacing distance between adjacent rows. The depth of each spout or louver below the bottom surface of the sheet member may be 0.15 inches. The thickness dimension "t" of sheet member 22 may be in the range of about 0.025 inches to about 0.100 inches with about 0.050 inches being mostly preferred.

The gutter cover apparatus of the present invention is intended to be installed on a rain gutter with a plurality being placed side-by-side along the longitudinal extent of the gutter. In this regard, the length of each sheet member 22 is discretionary and may be provided in any suitable convenient length with such exemplary sizes as 3 feet, 4 feet, and 6 feet being mostly preferred.

To fabricate the gutter cover apparatus 10 of the present invention, flat bar stock from a roll may be passed through a metal forming machine having various stations for bending, deforming, embossing, cutting, creasing and so on, as is well known in the metal working art.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved gutter cover apparatus that is low in cost, relatively simple in design and operation, and which may advantageously be used for protecting a building rain gutter. With the invention, a gutter cover apparatus (1) provides a cover for gutter that is easy to install, relatively inexpensive to fabricate, and is durable over time; (2) provides a gutter cover that includes an enhanced number of drainage openings per unit/area thereby efficiently draining rainwater runoff into a roof gutter all of the while protecting the gutter from filling with leaves or other debris; (3) provides a gutter cover that includes means for preventing wet leaves or other debris from sticking in place over the openings in the gutter cover and thereby reducing its effectiveness; (4) provides means for retarding the flow of water runoff across the surface of the cover to help reduce the velocity of the flowing water and help lift debris away from the surface of the cover; (5) provides a gutter cover that includes means for reducing the amount of debris lodging behind the gutter structure; and (6) provides a gutter cover that includes a drip edge so configured and constructed to effective to reduce staining of the gutter's front surface (i.e. helps to eliminate "tiger striping").

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A gutter cover apparatus for-a rain gutter, said rain gutter having a front wall defining a front top edge, a rear wall defining a rear top edge, and a bottom wall extending transversely between said front wall and said rear wall to define a gutter interior space between said front and rear gutter walls, said apparatus comprising:

a sheet member having a top surface, an opposed bottom surface, a predetermined longitudinal extent, a predetermined thickness, a predetermined transverse extent, a front longitudinally extending portion for engaging said front wall top edge of said gutter, and a rear longitudinally extending portion for overlying said gutter rear wall top edge, said sheet member further including a longitudinally extending intermediate portion transversely extending between said sheet member front portion and said sheet member rear portion for overlying said interior space of said gutter, said sheet member longitudinally extending intermediate portion being substantially planar throughout its longitudinal and transverse extent, and wherein said substantially planar sheet member intermediate portion includes a multiplicity of drainage openings therein for allowing water impinging on said top surface of said sheet member to flow into said rain gutter interior when said apparatus is positioned on said rain gutter with said front portion resting on said gutter front wall top edge and said sheet member rear portion overlying said gutter rear wall top edge, said substantially planar sheet member intermediate portion further including means for maintaining leaves or other debris falling on said top surface of sheet member elevated with respect to said openings to avoid clogging of said openings, wherein said multiplicity of openings are arranged in a multiplicity of spaced longitudinally extending rows on said sheet member intermediate portion, and said means for maintaining leaves or other debris elevated with respect to said openings comprise at least one longitudinally extending ridge disposed on said sheet member top surface in the region of said sheet member intermediate portion, said at least one longitudinally extending ridge being disposed in such a manner as to divide said multiplicity of rows of openings into separate zones of rows of openings on said substantially planar longitudinally extending intermediate portion located respectively on opposite sides of said at least one longitudinally extending ridge, and wherein said front longitudinally extending portion includes a first longitudinally extending substantially planar section bent upwardly at a first obtuse angle with respect to said top surface of said substantially planar intermediate portion, a second longitudinally extending substantially planar section extending at a second acute angle with respect to a plane parallel to a top surface of said first longitudinally extending substantially planar section, a third longitudinally extending substantially planar section extending at a third acute angle with respect to a plane parallel to a top surface of said second longitudinally extending substantially planar section to define a longitudinally extending drip lip adapted to overhang said front wall top edge of said gutter and extend downwardly therefrom when said apparatus is positioned on said rain gutter with said second longitudinally extending substantially planar section of said front portion resting on said gutter front wall top edge and said sheet member rear portion overlying said rear wall top edge of said gutter, and wherein said predetermined transverse extent of said sheet member including said longitudinally extending drip lip has a combined transverse extent greater than the transverse extent between said rain gutter front wall and said rain gutter rear wall sufficient to enable said longitudinally extending drip lip to overhang said front wall top edge of said gutter and extend downwardly therefrom when said apparatus is positioned on said rain gutter with said second longitudinally extending substantially planar section of said front portion resting on said gutter front wall top edge and said sheet member rear portion overlying said rear wall top edge of said gutter as aforesaid.

2. The apparatus of claim 1 further including at least one additional longitudinally extending ridge disposed on said sheet member top surface in the region of said substantially planar sheet member intermediate portion, said at least one additional longitudinally extending ridge being spaced from said at least one longitudinally extending ridge to define first and second longitudinally extending ridges disposed on said substantially planar sheet member intermediate portion, and wherein said first and second spaced longitudinally extending ridges divide said multiplicity of rows of openings into three separate zones of rows of openings.

3. The apparatus of claim 2 wherein the rows of openings in each of said zones is staggered with respect to its adjacent rows of openings in each zone, respectively.

4. The apparatus of claim 2 wherein said ridges have a triangular cross-sectional shape terminating in a distal apex or peak elevated above said sheet member intermediate portion top surface.

5. The apparatus of claim 2 wherein a first of said three separate zones includes two rows of said openings, wherein a second of said three zones includes three rows of said openings, wherein a third of said three zones includes three rows of said openings.

6. The apparatus of claim 2 wherein a first of said three separate zones includes five rows of said openings, wherein a second of said three zones includes three rows of said openings, wherein a third of said three zones includes three rows of said openings.

7. The apparatus of claim 2 wherein said first and second spaced longitudinally extending ridges dividing said multiplicity of rows of openings into three separate zones of rows of openings are arranged substantially parallel to each other.

8. The apparatus of claim 1 wherein said first longitudinally extending section and second longitudinally extending section form a raised dam portion rising above and with respect to said top surface of said substantially planar intermediate portion for retarding water from flowing across said substantially planar intermediate portion of the sheet member and over said drip lip.

9. The apparatus of claim 1 wherein said rear longitudinally extending portion extends rearwardly and upwardly with respect to said substantially planar intermediate portion to define a longitudinally extending member for effectively blocking leaves and other debris from getting lodged behind said the gutter rear wall.

10. The apparatus of claim 9 wherein said gutter is adapted to be affixed to a fascia board by one or more gutter spikes passing through said gutter front wall, said gutter rear wall and into said fascia board, and wherein said apparatus rear longitudinally extending portion includes a section bent back upon itself to define a longitudinally extending bearing edge adapted to rest on one or more spikes when said gutter cover apparatus is positioned on said rain gutter with said front portion resting on said gutter front wall top edge and said sheet member rear portion overlying said rear wall top edge.

11. The apparatus of claim 1 wherein each said drainage opening is in the form of a downwardly directed spout extending entirely below both said top surface and said opposed bottom surface of said sheet member intermediate portion.

12. The apparatus of claim 11 wherein each said spout has an arcuately shaped wall terminating in a lip, said lip facing forwardly in the direction of said longitudinally extending front portion of said apparatus.

13. The apparatus of claim 1 wherein said sheet member is of a metallic material.

14. The apparatus of claim 13 wherein said metallic material is enamel-coated aluminum.

* * * * *